United States Patent [19]

Kärnä et al.

[11] Patent Number: 4,541,571

[45] Date of Patent: Sep. 17, 1985

[54] METHOD OF CONTROLLING A GRINDING PROCESS IN A POCKET GRINDER

[75] Inventors: Anssi Kärnä ; Heikki Liimatainen, both of Inkeroinen, Finland

[73] Assignee: Oy Tampella AB, Tampere, Finland

[21] Appl. No.: 440,298

[22] Filed: Nov. 9, 1982

[30] Foreign Application Priority Data

Dec. 1, 1981 [FI] Finland ..... 813842

[51] Int. Cl.[4] ..... B02C 23/18

[52] U.S. Cl. ..... 241/28; 241/30; 241/34

[58] Field of Search ..... 241/28, 34, 35, 280, 241/281, 30

[56] References Cited

FOREIGN PATENT DOCUMENTS 844057 7/1981 U.S.S.R. ..... 241/34

*Primary Examiner*—Howard N. Goldberg
*Assistant Examiner*—Joseph M. Gorski
*Attorney, Agent, or Firm*—Ladas & Parry

[57] ABSTRACT

A method of controlling a grinding process in a pocket grinder in which a batch of wood in at least one pocket is pressed against a rotating grindstone by a pressure shoe displaceable in the pocket. At predetermined intervals an apparently produced amount of pulp is calculated at separate measuring points of the grinding stroke of the pressure shoe and the specific energy consumption calculated on the basis of this amount of pulp is compared to a target figure for the specific energy consumption. The batch grinding is adjusted depending on a deviation of the specific energy consumption from the target figure. The compaction of the batch in the pocket during the stroke of the pressure shoe is taken into account in the grinding adjustment by correcting the calculated apparently produced amount of pulp in relation to a change in the density of the batch to be ground so that the fluctuations in the fineness of the pulp produced at separate measuring points of the pressure shoe are maintained as small as possible during the grinding stroke of the pressure shoe.

7 Claims, 8 Drawing Figures

Figure 1:
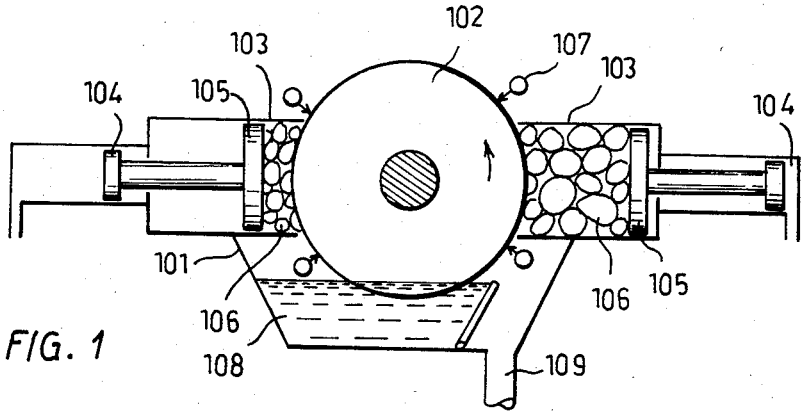

RELATION BETWEEN RELATIVE BATCH DENSITY AND STROKE POSITION DURING GRINDING OF TWO POCKETFULS

DEPENDENCE BETWEEN CSF VALUE AND APPARENT SEC DURING ONE GRINDING STROKE

DEPENDENCE BETWEEN CSF VALUE AND ACTUAL SEC

CONNECTION BETWEEN CSF VALUE AND SEC CORRECTED ON BASIS OF BATCH DENSITY

SEC CONTROL

METHOD OF CONTROLLING A GRINDING PROCESS IN A POCKET GRINDER

This invention relates to a method of controlling a grinding process in a pocket grinder in which a batch of wood in at least one pocket is pressed by means of a pressure shoe moving in the pocket against a rotating grindstone, whereby an apparently produced amount of pulp is calculated at predetermined intervals at separate measuring points of the grinding stroke of the pressure shoe and whereby a specific energy consumption calculated on the basis of said amount of pulp is compared to a target figure for the specific energy consumption and the course of the grinding of the batch is controlled depending on a deviation of said specific energy consumption from said target figure, in order to perform the grinding with the specific energy consumption remaining as constant as possible during the whole grinding stroke of the pressure shoe.

Mechanical pulp is produced in general in so-called pocket grinders in which wood batches in pockets are pressed by means of a loading cylinder and a pressure shoe against a rotating grindstone. The stone is sprayed with water for obtaining necessary cooling, lubrication and removal of pulp.

It is generally known that the production of mechancial pulp is unstable because of many occassionally varying factors. Such factors are e.g. the fluctuations in the quality, size and moisture of the logs, the purity of the stone surface, the stone quality, its surface pattern (sharpening pattern), the dullness of the grinding surface, and the force which presses the logs against the stone. The instability appears among other things as a fluctuation in the consistency, quality and fineness of the pulp. A so-called C.S.F. value, which correlates very well on one hand with rany quality characteristics of the pulp and on the other hand with the specific energy consumption, has been conventionally used as a measure of fineness. The specific energy consumption (SEC) is obtained by dividing the energy used during a certain period of time by the amount of pulp produced within the same period. In general, the greater the SEC is, the finer the pulp is i.e., the lower is the C.S.F. value of the pulp.

Typical methods utilized until now for controlling have been pressure, power and speed controls of the pocket grinder. By means of the pressure control the hydraulic pressure, which acts on the loading cylinder of the pressure shoe, is maintained constant during the whole grinding event. By means of the power control the rotation power of the grindstone is maintained constant and respectively by means of the speed control the speed of the pressure shoe is maintained constant.

It has, however, appeared that when said control methods are used a remarkable fluctuation occurs in the C.S.F. values of the pulp. The total amount of pulp produced when utlizing such methods of control consists of momentary heterogeneous portions of pulp, even if the total average C.S.F. value is correct and desired. The situation is disadvantageous both for the control of the process and for the uniform quality of the pulp.

Because a reliable measurement of the C.S.F. value takes time and it has to be performed in a laboratory and because other measuring equipment which must be coupled to the process are only deficiently adapted for obtaining a quick and accurate control, efforts have recently been made to obtain an automatic control of the SEC.

In principle it is simple to carry out SEC control. The produced amount of pulp and the energy used for a predetermined period shall be measured, the achieved SEC shall be calculated therefrom and new set values calculated from the known operating characteristics shall be transmitted to the controller of the hydraulic pressure, the rotation power or the pressure shoe speed, depending on the method of the control utilized.

No problems occur in practice in the measurement of the used energy. Instead it has proved to be problematic, to measure and estimate the produced amount of pulp reliably enough. One way is to measure the produced pulp amount as a product of the flow of the pulp and the consistency of the pulp. The measurement of the flow can be carried out without difficulties, but a continuous measurement of the consistency of the pulp e.g. immediately after grinding is in practice not a solution. Another way is to measure the produced amount of pulp as a product of the pocket volume displaced by the pressure shoe and the density of the batch in the pocket. The displaced pocket volume can be measured by following the movement of the pressure shoe which can be done by means of instruments following and registering the movements of e.g. the hydraulic cylinder. The average density based upon long experiences, e.g. 294 kg/m$^3$ for spruce, has been considered as the density of a batch. In order to obtain a constant SEC level the density of the batch has been maintained constant from one grinding stroke to another and within the stroke in hitherto existing methods of control. Such a method of controlling is known e.g. from the publication 1980 PROCESS CONTROL CONFERENCE, CPPA Technical Section, Montreal June 17–19, sides 121 to 133, containing an article "The SCS package control systems for the control of the mechanical pulping process". In this article control equipment has been described in which the SEC of the grinding event is measured for control purpose. This is carried out by measuring the apparent SEC by means of a measuring element, which follows the movement of the pressure shoe.

It has, however, proved that the so far existing suggestions to carry out a so-called SEC control have resulted in a rather great inaccuracy and have not been able to minimize the fluctuations in the C.S.F. value of the pulp. A partial reason is that the measuring and control periods are long, typically several minutes.

The purpose of this invention is to provide a control method which eliminates the above-mentioned disadvantage and which makes it possible to keep the SEC as constant as possible during the whole grinding stroke and to minimize the fluctuations in the C.S.F. value of the produced pulp. This purpose is obtained by means of the method according to the invention, which is characterized in that the calculated value of the apparently produced amount of pulp is corrected in relation to the density of the batch to be ground at said measuring points of the grinding stroke of the pressure shoe.

The invention is based on the observation that the density of the batch, which is pressed by the pressure shoe against the grindstone, changes when the stroke of the pressure shoe proceeds. Measurements have indicated that when the grindstone is rotated by a constant power the pressure shoe speed in general drops and that when the pressure shoe is moved with a constant speed the rotation power in general rises, which indicates that the density of the batch increases. This is understandable because the logs of the batch are under the influence of the force of the pressure shoe displaced tighter between each other and against the surface of the grindstone.

A basic comprehension of the invention when controlling the grinding process in order to maintain the SEC constant is to take the above-mentioned compaction phenomena of the batch of wood during the grinding stroke into consideration. In this way the amount of pulp, which is produced in different phases of the grinding stroke of the pressure shoe, can be calculated by using a variable actual density of the batch when the stroke proceeds instead of the produced amount of pulp being calculated in different phases of the grinding stroke with the same unchanged average density of the batch. The produced amount of pulp so calculated corresponds better to reality whereby the SEC at that moment calculated by means of said calculated produced amount of pulp gives a more truthful picture of the control need of the grinding process in order to maintain the SEC as constant as possible. When the SEC better follows the target value during the grinding stroke of the pressure shoe, the fluctuation of the C.S.F. value of the pulp also diminishes.

Figure 2:
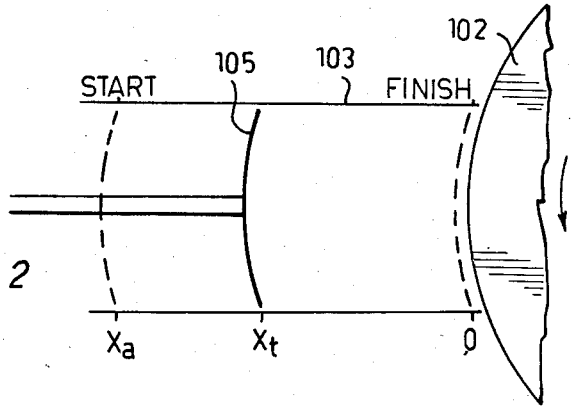
Figure 3:
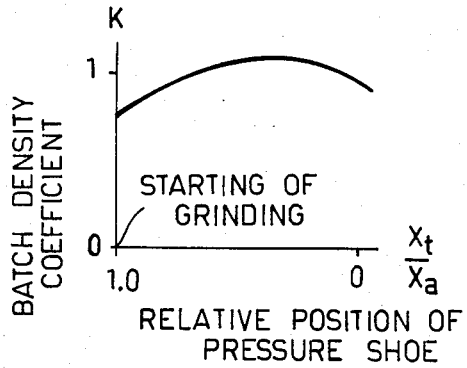
Figure 4:
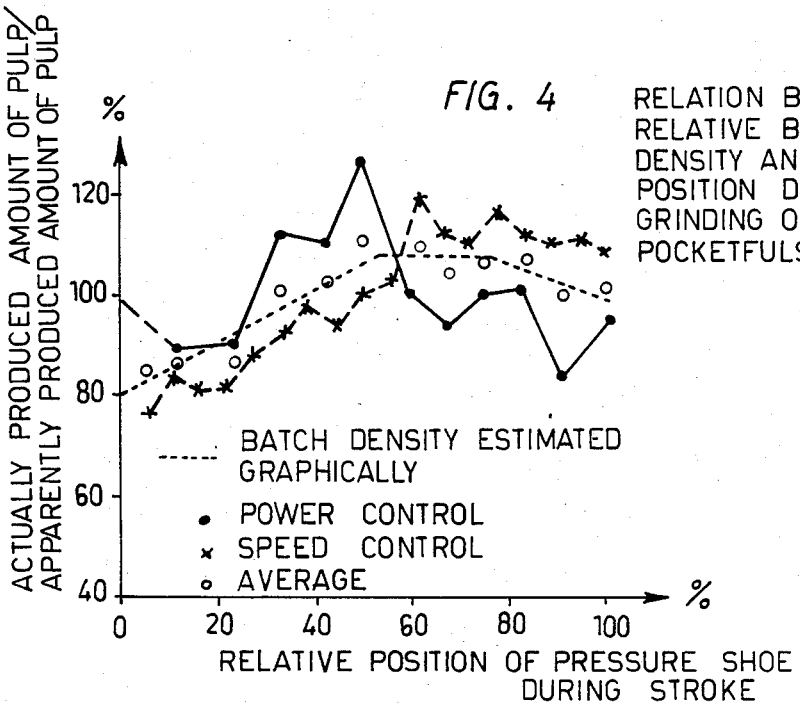
Figure 5:
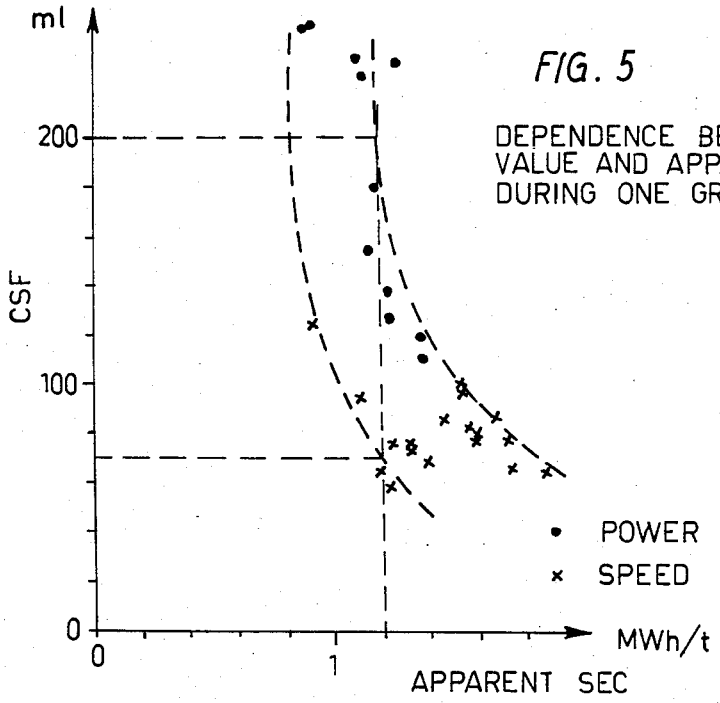
Figure 6:
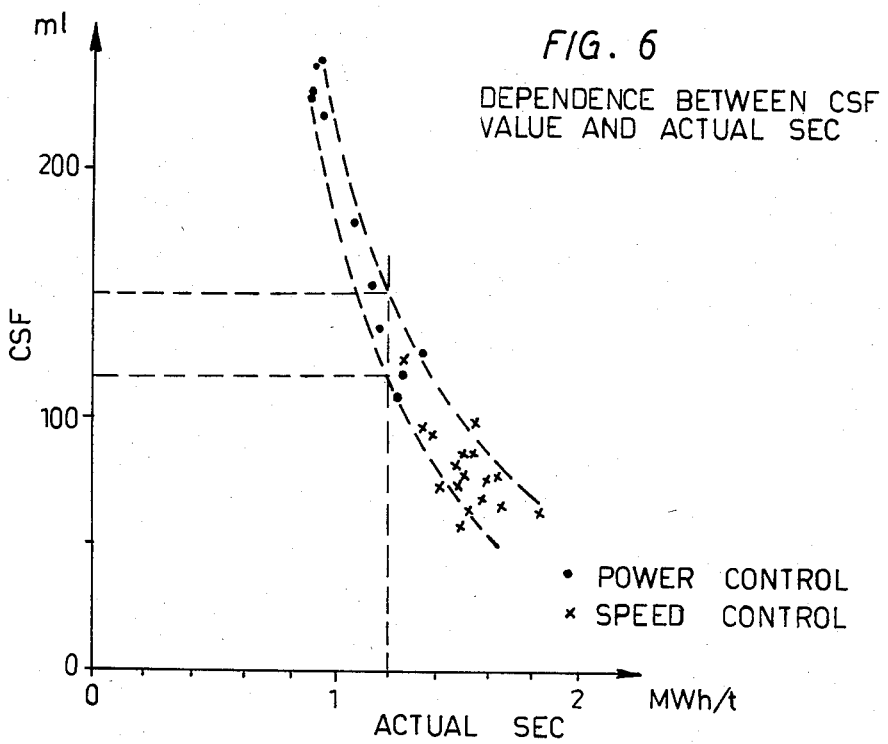
Figure 7:
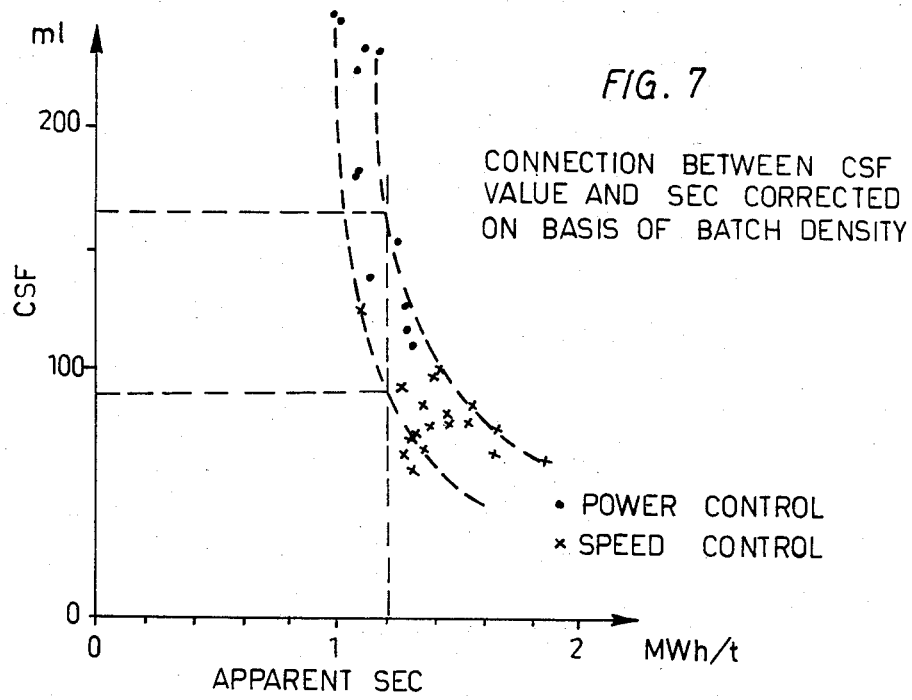
Figure 8:
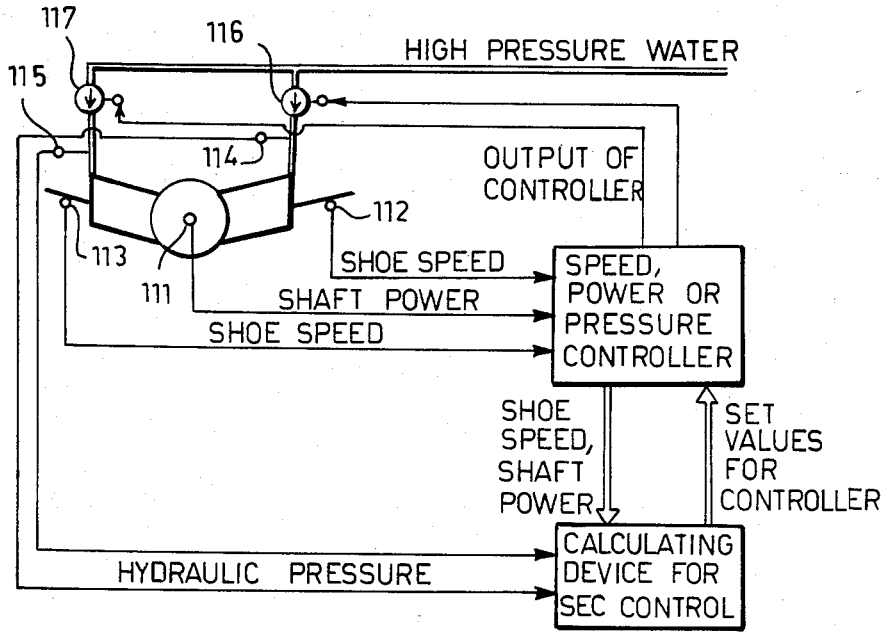

The invention is described in more detail in the following with reference to the enclosed drawings, in which FIG. 1 is a schematic view of a grinder suitable for carrying out the method according to the invention, FIG. 2 is a schematic view illustrating the measurement of the position of the pressure shoe, FIG. 3 is a graph view illustrating the coefficient for a batch density as a function of the relative position of the pressure shoe, FIG. 4 is a graphs view illustrating as an example the coefficient of the batch density, FIGS. 5, 6 and 7 are graphical views illustrating the dependence of the C.S.F. value of the pulp on the apparent SEC value, on the actual SEC value and correspondingly on the SEC value corrected on the basis of the batch density and FIG. 8 is view illustrating a measurement equipment for carrying out the control method.

The grinder illustrated in FIG. 1 of the drawings, which preferably is of a type operating under continuous overpressure, comprises a body 101, a grindstone 102 rotatably mounted in the body and two pockets 103 on opposite sides of the grindstone. A pressure shoe 105 displaceable by means of a hydraulic cylinder 104 operates in each pocket. A vertical charging slot, which is not illustrated, is arranged above each pocket for a batch of wood 106 to be fed into the pocket. Shower water is sprayed onto the grindstone through nozzles 107. A pit 108 is arranged below the grindstone for the pulp suspension, and an outlet pipe is provided from the pit for further processing of the pulp.

At first a situation shall be examined in which speed control is used as a basic control method for accomplishing a SEC goal and in which only one pocket is used for grinding.

As mentioned above, the SEC consumed for grinding is equal to the energy (W), which is spent during a certain period, divided by the amount of pulp (M) produced during the corresponding period. The energy spent is equal to the shaft power (P) of the driving motor of the grindstone multiplied by the time (t). Therefore, on the examination period t, which can last e.g. 15 seconds $$SEC_t = \frac{W_t}{M_t} = \frac{P \times t}{M_t} \quad \text{(I)}$$

The produced amount of pulp (M) is equal to the pocket volume displaced by the pressure shoe, multiplied by the density of the batch in the pocket. Therefore, on the examination period t $$M_t = A \times X_t \times D_w \times K_t \quad \text{(II)}$$

wherein

A = the cross-sectional surface of the pocket, $X_t$ = the distance of movement of the pressure shoe during the time period t, $D_w$ = the average density of the batch in the pocket during the grinding, $K_t$ = a correction factor of the batch density i.e. a batch density coefficient which is a function of the relative position of the pressure shoe.

FIG. 2 illustrates the position of the pressure shoe during grinding.

The size of the batches varies e.g. due to variations in the shapes of the logs and due to variations in the setting of the logs in the feeding pocket. When the pressure shoe at the beginning of the grinding stroke is pressed against the logs, the variation in the batch size results in the initial position $X_a$ of the pressure shoe when the grinding begins varying for different chargings. This position can be measured e.g. by means of a pulse encoder which follows the movement of the pressure shoe. On the other hand, the final position of the pressure shoe is always the same and therefore this position is kept as a zero point with which the position of the pressure shoe is compared. Likewise the average position $X_t$ of the pressure shoe is defined at the examination period and an average relative position $X_{st}$ of the pressure shoe is calculated $$X_{st} = \frac{X_t}{X_a}.$$

The average position $X_t$ of the pressure shoe can be defined e.g. by measuring the position of the pressure shoe in the middle of the examination period. Alternatively, the position of the pressure shoe can be measured at the beginning and at the end of the examination period and their average can be calculated. When desired the position of the pressure shoe can be measured at several points and the exact average position can be calculated for the pressure shoe by different mathematical methods.

FIG. 3 illustrates as an example the dependence of the batch density coefficient K on the relative position of the pressure shoe. The batch density coefficent $K_t$ corresponding to the relative position of the pressure shoe at each examination period t is obtained from a curve. The batch density coefficient can of course be expressed in whatsoever way comparable to the position and the movement of the pressure shoe, which provides the value of the coefficient $K_t$ with a sufficient accuracy in practice. E.G. the absolute position of the pressure shoe in the pocket, the distance of the movement of the pressure shoe in the pocket after the grinding stroke has begun etc. can then be used as a figure of comparison.

The $SEC_t$ corresponding to the examination period t can now be calculated from formulas (I) and (II). If the $SEC_t$ differs from the target figure, a correction of the speed of the pressure shoe is carried out in order to adjust the SEC to the target figure. During the following examination period the same measurements and calculations are performed taking into consideration the change in the density of the batch and a correction of the shoe speed is carried out. The basic rule is that when the speed increases, the SEC drops.

In this way it is possible to take into consideration the changes in the batch density during the stroke of the pressure shoe (in general about 5–20 minutes) during the grinding (e.g. with intervals of 15 seconds) and to carry out the necessary corrections in the pressure shoe speed so that the SEC remains as constant as possible and thereby also the fluctuations of the C.S.F. value of the pulp remain during the grinding as small as possible. A procedure wherein the SEC control has been carried out as a speed control of the pressure shoe has been described above. The SEC control according to the invention can be correspondingly carried out by using a power control, whereby the set value of the power is changed for maintaining a constant SEC (when the power is increased, the SEC diminishes). Alternatively the SEC control can be carried out by using a pressure control, whereby the set value of the hydraulic pressure of the hydraulic cylinder is changed (when the pressure is increased, the SEC diminishes). In addition to these methods a method of control can be considered in practice, in which a control valve for the hydraulic pressure of the hydraulic cylinder of the pressure shoe is adjusted directly on the basis of the SEC deviation, whereby the SEC diminishes when the valve is opened and vice versa.

The tables 1 and 2 on the following pages illustrate an analysis of two grinding strokes in the pocket grinder when the process is adjusted by means of a so-called power control or correspondingly by a speed control. The samples were collected during about 30 seconds at intervals of 1 minute, whereby the time delay from the stone to the sampling point was about 10 seconds. The duration times of the strokes of grinding were 11 and 18 minutes. An empirical value $D_w$=294 kg/m$^3$ has been used in the tables as an average density of the batch in the pocket during the grinding.

The actually produced amount of pulp (pulp amount =flow rate × consistency) has been calculated in column (10) of the tables on the basis of columns (8) and (9), and the apparently produced amount of pulp, calculated on the basis of the pocket cross-sectional area A, the average batch density $D_w$ and the pressure shoe speed v, is shown in column (11). The average of column (10) in table 1 is 0.853 and the average of column (11) is 0.793. On this basis it can be established that the relation of the averages between the actually and apparently produced amount of pulp was 1.076. Table 2 gives 0.935 for the corresponding relation.

TABLE 1

Analysis of a grinding stroke in the pocket grinder; power control
A single pocket, A = 1.05 m$^2$
Pitless grinding
$D_w$ = 294 kg/m$^3$

| Time from start of grinding min (1) | Grinding power P MW (2) | Hydr. pressure Ph bar (3) | Pressure shoe speed v m/h (4) | Relative position of shoe $X_{st}$ (5) | Density coefficient $K_t$ (6) | CSF ml (7) | Consistency (abs.d.) % (8) | Spray waters qv l/s (9) |
|---|---|---|---|---|---|---|---|---|
| 1 | 0.89 | 7.61 | 3.29 | 0.88 | 0.86 | 243 | 1.76 | 13.70 |
| 2 | 0.90 | 7.83 | 3.23 | 0.77 | 0.92 | 244 | 1.77 | 13.70 |
| 3 | 0.90 | 7.90 | 2.68 | 0.67 | 0.98 | 231 | 1.83 | 13.71 |
| 4 | 0.90 | 7.73 | 2.61 | 0.58 | 1.02 | 223 | 1.75 | 13.73 |
| 5 | 0.91 | 7.89 | 2.35 | 0.50 | 1.07 | 230 | 1.83 | 13.71 |
| 6 | 0.90 | 8.03 | 2.48 | 0.41 | 1.08 | 180 | 1.53 | 13.69 |
| 7 | 0.90 | 8.17 | 2.39 | 0.32 | 1.08 | 137 | 1.38 | 13.74 |
| 8 | 0.90 | 8.25 | 2.13 | 0.25 | 1.07 | 119 | 1.30 | 13.67 |
| 9 | 0.89 | 8.39 | 2.10 | 0.17 | 1.05 | 110 | 1.29 | 13.76 |
| 10 | 0.89 | 7.84 | 2.35 | 0.09 | 1.04 | 127 | 1.21 | 13.65 |
| 11 | 0.90 | 7.84 | 2.52 | 0 | 1.00 | 154 | 1.43 | 13.73 |

| Time from | Produced pulp amount t/h, 90% | | | SEC, MWh/t | | |
|---|---|---|---|---|---|---|
| start of grinding min (1) | Actual k'× (8) × (9) k' = 0.04 (10) | Apparent A × $D_w$ × (4) (11) | Corrected apparent K × (11) (12) | Actual (2)/(10) (13) | Apparent (2)/(11) (14) | Corrected apparent (2)/(12) (15) |
| 1 | 0.97 | 1.02 | 0.88 | 0.92 | 0.87 | 1.01 |
| 2 | 0.98 | 1.00 | 0.92 | 0.92 | 0.90 | 0.98 |
| 3 | 1.00 | 0.83 | 0.81 | 0.90 | 1.08 | 1.11 |
| 4 | 0.96 | 0.81 | 0.83 | 0.94 | 1.11 | 1.08 |
| 5 | 1.01 | 0.73 | 0.78 | 0.90 | 1.25 | 1.17 |
| 6 | 0.84 | 0.77 | 0.83 | 1.07 | 1.17 | 1.08 |
| 7 | 0.76 | 0.74 | 0.80 | 1.18 | 1.22 | 1.13 |
| 8 | 0.71 | 0.66 | 0.71 | 1.27 | 1.36 | 1.27 |
| 9 | 0.71 | 0.65 | 0.68 | 1.25 | 1.37 | 1.31 |
| 10 | 0.66 | 0.73 | 0.76 | 1.35 | 1.22 | 1.17 |
| 11 | 0.79 | 0.78 | 0.78 | 1.14 | 1.15 | 1.15 |
| Average | 0.853 | 0.793 | | | | |
| | k = 1.076 | | | | | |

TABLE 2

Analysis of a grinding stroke in the pocket grinder; speed control
A single pocket, A = 1.05 $m^2$
Pitless grinding
$D_w$ = 294 kg/$m^3$

| Time from start of grinding min (1) | Grinding power P MW (2) | Hydr. pressure Ph bar (3) | Pressure shoe speed v m/h (4) | Relative position of shoe $X_{st}$ (5) | Density coefficient $K_t$ (6) | CSF ml (7) | Consistency (abs.d.) % (8) | Spray waters qv l/s (9) |
|---|---|---|---|---|---|---|---|---|
| 1 | 0.57 | 4.77 | 2.03 | 0.94 | 0.84 | 125 | 0.80 | 13.93 |
| 2 | 0.66 | 5.40 | 1.95 | 0.89 | 0.87 | 94 | 0.84 | 14.06 |
| 3 | 0.76 | 6.46 | 2.00 | 0.83 | 0.89 | 76 | 0.84 | 14.01 |
| 4 | 0.77 | 6.76 | 2.11 | 0.78 | 0.92 | 65 | 0.88 | 14.15 |
| 5 | 0.77 | 7.00 | 2.00 | 0.72 | 0.95 | 59 | 0.90 | 14.19 |
| 6 | 0.34 | 7.22 | 2.06 | 0.66 | 0.98 | 75 | 0.99 | 14.03 |
| 7 | 0.81 | 7.23 | 2.01 | 0.61 | 1.00 | 74 | 1.02 | 14.10 |
| 8 | 0.85 | 7.81 | 1.98 | 0.55 | 1.03 | 68 | 0.92 | 14.22 |
| 9 | 0.87 | 8.32 | 1.95 | 0.50 | 1.06 | 86 | 0.99 | 14.19 |
| 10 | 0.97 | 8.15 | 2.06 | 0.44 | 1.08 | 100 | 1.12 | 13.94 |
| 11 | 0.94 | 7.55 | 2.00 | 0.38 | 1.08 | 97 | 1.22 | 14.04 |
| 12 | 0.97 | 7.75 | 2.01 | 0.33 | 1.08 | 82 | 1.16 | 14.00 |
| 13 | 0.98 | 7.68 | 2.01 | 0.27 | 1.08 | 79 | 1.15 | 14.02 |
| 14 | 1.03 | 8.14 | 2.01 | 0.22 | 1.08 | 86 | 1.21 | 14.04 |
| 15 | 1.09 | 8.50 | 2.03 | 0.16 | 1.05 | 77 | 1.18 | 14.00 |
| 16 | 1.01 | 7.58 | 2.06 | 0.11 | 1.03 | 78 | 1.18 | 13.96 |
| 17 | 1.04 | 8.27 | 1.93 | 0.05 | 1.02 | 66 | 1.10 | 14.10 |
| 18 | 1.14 | 9.56 | 1.99 | 0 | 1.00 | 64 | 1.11 | 13.96 |

| Time from | Produced pulp amount t/h, 90% | | | SEC, MWh/t | | |
|---|---|---|---|---|---|---|
| start of grinding min (1) | Actual k' × (8) × (9) k' = 0.04 (10) | Apparent A × $D_w$ × (4) (11) | Corrected apparent K × (11) (12) | Actual (2)/(10) (13) | Apparent (2)/(11) (14) | Corrected apparent (2)(12) (15) |
| 1 | 0.45 | 0.63 | 0.53 | 1.27 | 0.90 | 1.10 |
| 2 | 0.47 | 0.60 | 0.52 | 1.40 | 1.10 | 1.27 |
| 3 | 0.47 | 0.62 | 0.55 | 1.62 | 1.23 | 1.38 |
| 4 | 0.50 | 0.65 | 0.60 | 1.54 | 1.18 | 1.28 |
| 5 | 0.51 | 0.62 | 0.59 | 1.51 | 1.24 | 1.31 |
| 6 | 0.56 | 0.64 | 0.63 | 1.50 | 1.31 | 1.33 |
| 7 | 0.57 | 0.62 | 0.62 | 1.42 | 1.31 | 1.31 |
| 8 | 0.53 | 0.61 | 0.63 | 1.60 | 1.39 | 1.35 |
| 9 | 0.56 | 0.60 | 0.64 | 1.55 | 1.45 | 1.36 |
| 10 | 0.62 | 0.64 | 0.69 | 1.56 | 1.52 | 1.41 |
| 11 | 0.69 | 0.62 | 0.67 | 1.36 | 1.52 | 1.40 |
| 12 | 0.65 | 0.62 | 0.67 | 1.49 | 1.56 | 1.45 |
| 13 | 0.64 | 0.62 | 0.67 | 1.53 | 1.58 | 1.46 |
| 14 | 0.68 | 0.62 | 0.66 | 1.51 | 1.66 | 1.56 |
| 15 | 0.66 | 0.63 | 0.66 | 1.65 | 1.73 | 1.65 |
| 16 | 0.66 | 0.64 | 0.66 | 1.53 | 1.58 | 1.53 |
| 17 | 0.62 | 0.62 | 0.63 | 1.68 | 1.73 | 1.65 |
| 18 | 0.62 | 0.61 | 0.61 | 1.84 | 1.87 | 1.87 |
| Average | 0.581 | 0.622 | | | | |
| | k = 0.935 | | | | | |

The relative position of the pressure shoe $X_{st}$ and a correction coefficient $K_t$ of the density estimated according to FIG. 4 have been calculated in columns (5) and (6) of the tables. The apparently produced amount of pulp corrected by means of the density coefficient, has been calculated in column (12).

The actual, apparent and corrected apparent SEC correspondingly have been calculated in column (13), (14) and (15) of the tables.

The actually produced amount of pulp (10) divided by the apparently produced amount of pulp (11) have been illustrated in FIG. 4 as a function of the position of the pressure shoe from each table. In order to make the graphic solution easier, the curves have been drawn commensurable by multiplying the calculated values of both curves with the relation between the averages of the amounts of pulp obtained in the measurement in question. The average density curve adaptable to these examples and which has been used according to the invention for defining the batch density coefficient has been drawn with dotted lines in FIG. 4. The value of the correction coefficient $K_t$ corresponding to each position of the pressure shoe, which value is used when the produced amount of pulp is calculated according to the formula II, is obtained from the curve. Hereafter the $SEC_t$ value of each examination period t, which value is comparable to the target value of the SEC, can be calculated according to the formula I. The grinding process is correspondingly adjusted on the basis of a deviation so that the target value of the SEC can be achieved.

FIGS. 5, 6 and 7 illustrate the dependence of the CSF value of the pulp on the apparent SEC, actual SEC and on the SEC corrected on the basis of the batch density. FIG. 5 illustrates that when the SEC is calculated in an earlier known way according to the formula (II) without taking into account the batch density ($K_t$=1), the fluctuation in the CSF value is great, even if attempts have been made to maintain the SEC constant. E.g. on the SEC level 1.2 MWh the fluctuation of the CSF value is between 70–200 ml. FIG. 6 illustrates that when the SEC is calculated on the basis of the actual circumstances, the fluctuation in the CSF value on the same SEC level is only 120–150 ml. FIG. 7 illustrates that when the SEC is calculated according to the formula II, but taking into consideration the change in the batch density according to FIG. 4, the fluctuation in the CSF value on the same SEC level is 95–170 ml. It is noticed that the SEC calculated according to the invention correlates better with the CSF value and is therefor more suitable for the grinding control than the SEC calculated in the known way.

FIG. 8 illustrates an embodiment for carrying out the method according to the invention. Reference numeral 111 indicates a measuring instrument, which measures the shaft power of the grindstone. Reference numerals 112 and 113 indicate pulse encoders, which measure the pressure shoe speed for each pocket. Reference numerals 114 and 115 indicate pressure gauges, which measure the hydraulic pressure of the piston for each pressure shoe. Reference numerals 116 and 117 indicate control valves, by means of which the hydraulic pressure acting behind the piston of each pocket pressure shoe can be adjusted and consequently the speed of the pressure shoes and the shaft power can be influenced.

The pulse encoders can be of the type LITTON SERVOTECHNIK, G 70 SSTLB1 - 1000 - 111 - 05PX, BRD.

The drawings and the specification relating thereto are only intended to illustrate the idea of the invention. In its details the method according to the invention may vary within the scope of the claims. A final form based on a wider study has to be established in practice for the batch density curve illustrated in FIG. 4. A control for a single pocket has been described above as an example. When both pockets of the grinder grind it is possible to divide the total energy of the grindstone between the pockets e.g. in relation to the hydraulic pressures of their pressure shoes or in some other adaptable way and to calculate control instructions for each pocket separately in the above described way.

In practice, it is also possible to adapt the SEC control according to the invention so that both pockets are operated in the same way, whereby the production of each pocket is measured and calculated as above and the joint production obtained is used for the calculation of the SEC. In that case the energy of the grindstone does not need to be divided between the pockets. Likewise the pockets can be adjusted separately in such a way the productions of the pockets during the examination period t are equal when the density coefficient $K_t$ has been taken into consideration, whereby the rotation power of the stone also does not need to be divided.

What we claim are:

1. A method of controlling a grinding process in a pocket grinder comprising the steps of:

pressing a batch of wood in at least one pocket against a rotating grindstone by means of a pressure shoe displaceable in the pocket, density of the wood in the batch being other than constant;

calculating, at predetermined intervals at measuring points of a grinding stroke of the pressure shoe, an amount of pulp produced, said calculating being defined by the relationship:

$$M_t = A \cdot X_t \cdot D_w$$

wherein

A = cross-sectional area of the pocket, $X_t$ = distance of movement of the pressure shoe during the time period t, and $D_w$ = average density of the batch in the pocket during the grinding;

calculating a value of specific energy consumption corresponding to said amount of pulp produced;

comparing the specific energy consumption to a target figure;

controlling the grinding of the batch in response to a deviation of said specific energy consumption from said target figure, so that the specific energy consumption remains as constant as possible during an entire grinding stroke of the pressure shoe;

determining a correction factor for the density of the wood in the batch as a function of position of said pressure shoe; and calculating a corrected amount of pulp produced by multiplying said amount of pulp produced by said correction factor, whereby the value of said specific energy is corrected to control at least one operating parameter of said pocket grinder.

2. A method according to claim 1 in which:

the correction factor is utilized during grinding of subsequent batches of wood and the specific energy consumption is calculated to correspond to:

(a) power used to rotate the grindstone, and (b) the corrected amount of pulp produced.

3. A method according to claim 1, in which rotational power of the grindstone is the parameter adjusted.

4. A method according to claim 1, in which speed of the pressure shoe is the parameter adjusted.

5. A method according to claim 1, in which hydraulic pressure of the pressure shoe is the parameter adjusted.

6. A method according to claim 1, in which a pressure supply valve of a hydraulic cylinder of the pressure shoe is adjusted to control said specific energy.

7. A method according to claim 1 in which pulp produced by grinding is mixed with a pulp suspension in a pit below said grindstone.

* * * * *